US005351957A

United States Patent [19]

Scott

[11] Patent Number: 5,351,957

[45] Date of Patent: Oct. 4, 1994

[54] VERTICALLY ASSEMBLED PUZZLES

[76] Inventor: Donald W. Scott, 8265 Davis Road (Rte. 240), P.O. Box 218, Colden, N.Y. 14033

[21] Appl. No.: 134,261

[22] Filed: Oct. 8, 1993

[51] Int. Cl.[5] ..... A63F 9/12

[52] U.S. Cl. ..... 273/157 R

[58] Field of Search ..... 273/157 R, 157 A, 160

[56] References Cited

U.S. PATENT DOCUMENTS

| | | | |
|---|---|---|---|
| 292,598 | 1/1884 | Stranders | 273/157 R |
| 1,702,505 | 2/1929 | Groves | 273/157 R |
| 1,964,007 | 6/1934 | Parks | 273/157 R |
| 2,506,189 | 5/1950 | Attridge | 273/157 R |
| 3,334,798 | 8/1967 | Pezely, Jr. et al. | 273/157 R X |
| 4,824,112 | 4/1989 | Roy | 273/157 R |
| 5,219,168 | 6/1993 | Morris | 273/157 R |

FOREIGN PATENT DOCUMENTS 2068743 8/1981 United Kingdom ..... 273/157 R

OTHER PUBLICATIONS

Oz Puzzle Co. advertisement "Oz Jig Saw Cubes" 1 page, 1975.

*Primary Examiner*—William H. Grieb

[57] ABSTRACT

A jigsaw puzzle comprising four frame pieces and a multiplicity of interior pieces designed to be assembled in a vertical format with the additional problem solving dimensions being required to complete the solution of the puzzle which can be partially assembled using classical jigsaw puzzle solving skills, in which the graphic design is such that the interior pieces represent windows of a building and the frame pieces represent the edges and corners of a building, and where the box into which the entire puzzle can be packaged is used as a support around which to assemble the frame.

6 Claims, 6 Drawing Sheets

VERTICALLY ASSEMBLED PUZZLES

BRIEF SUMMARY OF THE INVENTION

The objects of the present invention are to provide another dimension in solving jigsaw puzzles, to add different skills to those classical skills required for solving jigsaw puzzles, to make it possible to work on jigsaw puzzles on a wide variety of horizontal surfaces including surfaces which would not hold all of the pieces if assembled in one plane, to make it possible to assemble a jigsaw puzzle in vertical planes rather than only in a horizontal plane, to provide a means for solving a jigsaw puzzle representing a building by assembling the pieces on the vertical surfaces which comprise the walls of the building, and to provide a unique and economical method of supporting the surfaces which are the assembled and partially assembled walls. This invention is a jigsaw puzzle comprising hinged interlocking frame pieces and fully interlocking interior pieces and a method of solving the puzzle requiring deductive reasoning in addition to classical jigsaw puzzle solving skills. The puzzle is designed to be assembled in a vertical format such that it occupies little horizontal surface area and such that a spatial dimension is added to the puzzle. Graphically, the frame pieces are designed as the corners of a multistory building and the interior pieces are assembled into windows of the building, any of which fits into any window space. Correct placement into the frame is determined from information available only in the sum of all the correctly assembled windows. A rectangular box is designed both to be used as a support for the frame and interior pieces, and as a packaging container for the entire puzzle.

BACKGROUND OF THE INVENTION

Jigsaw puzzles have been in existence for about two hundred fifty years. Usually, a piece of art is laminated or printed on a wooden, paper or plastic board and the board is subsequently cut into many, sometimes interlocking, pieces. It is then a challenging activity to reassemble the pieces by matching shapes, colon, and patterns. The usual form of such puzzles is a flat, two-dimensional scene. When the puzzle comprises hundreds of pieces, a horizontal surface must be chosen upon which to solve the puzzle which is at least as large in both directions as the puzzle. In practice, the puzzle requires about twice as much area unassembled as when it is assembled. There have been examples of thick, wooden puzzles which could stand on their edges as in animal puzzles for children and jigsaw puzzles of many different materials which have been made to stand on their edges by means of a base or stand into which the edge is inserted. These vertical puzzles have involved relatively few pieces. There have been jigsaw puzzles known as inlays which can be assembled into trays comprising a frame around non interlocking interior pieces and a bottom or backing board which supports the assembly activity and supports the interior pieces when assembled. There has never been a method of solving an ordinary jigsaw puzzle with hundreds of pieces of paper board laminated with printed paper in a vertical format.

Jigsaw puzzle workers enjoy a challenge. The greater the challenge, the greater their pleasure and satisfaction. The only skills required, however, have always been the matching of shapes, colors, and patterns. The puzzles have only been made more difficult by making the shapes of pieces more nearly identical, by making the colors more and more similar, and by making any differences in patterns of line and color less discernible, and of course by increasing the number of pieces.

DETAILED DESCRIPTION OF INVENTION AND DRAWINGS

Figure 1:
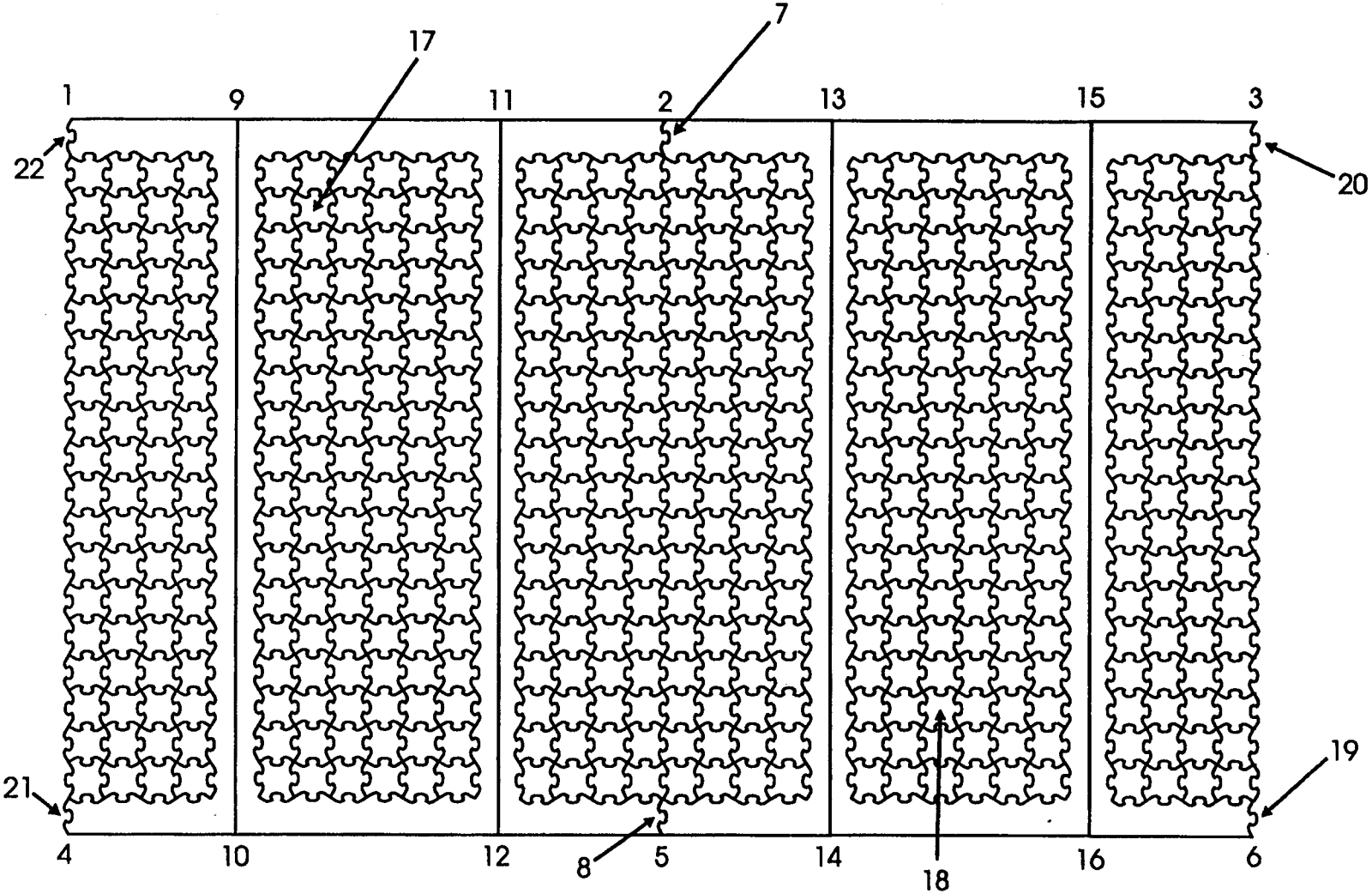
FIG. 1 is a top view of a preferred embodiment of a jigsaw puzzle, assembled as cut in an interconnected horizontal format, with all artwork removed, showing the lines which represent the cuts separating the puzzle into interlocking interior pieces and frame pieces.

FIG. 1 shows, completely assembled and as cut in a single plane, a puzzle which is a preferred embodiment of the present invention before it is broken up into interlocking interior pieces and four rectangular frame pieces connected to each other by hinged joints. The interior pieces are typified by 17 and 18. There are four frame pieces, two of which have been cut into two half-frame pieces each. The first rectangular frame piece is defined by the four corner points 9, 11, 12, and 10, reading clockwise around the perimeter. The second rectangular frame piece is defined by corner points 11, 13, 14, and 12, reading clockwise around the perimeter. The third rectangular frame piece is defined by corner points 13, 15, 16, and 14, reading clockwise. The fourth rectangular frame piece comprises two half-frame pieces, the first of which is defined by corner points 1, 9, 10, and 4 and the second of which is defined by corner points 15, 3, 6, and 16. It will be shown and it is obvious that the two halves of the fourth frame piece can be connected so that point 1 is coincident with point 3 and point 4 is coincident with point 6. Locking means 20 cooperates with locking means 22, and locking means 19 cooperates with locking means 21 to hold the two half-frame pieces together after they are manually connected during the solution of the puzzle. After connection, the fourth frame piece would be defined by corner points 15, 9, 10, and 16. The second frame piece (11, 13, 14, 12) is also cut into two half-frame pieces along the interlocking line 2–5. The two halves of the second frame piece are still connected as shown by typical jigsaw puzzle interlocks at 7 and 8. It can be seen that the frame pieces surround and interlock with the interior pieces. The frame pieces are connected to each other at edge joints described by lines 9–10, 11–12, 13–14, and 15–16. The hinged means of connection can be a strip of tape, a mechanical hinge, or the paper jigsaw puzzle board cut partially but not completely through the thickness of the board. It is this last type of hinged joint which is part of the preferred embodiment of the invention and shown more clearly in FIG. 3.

Figure 2:
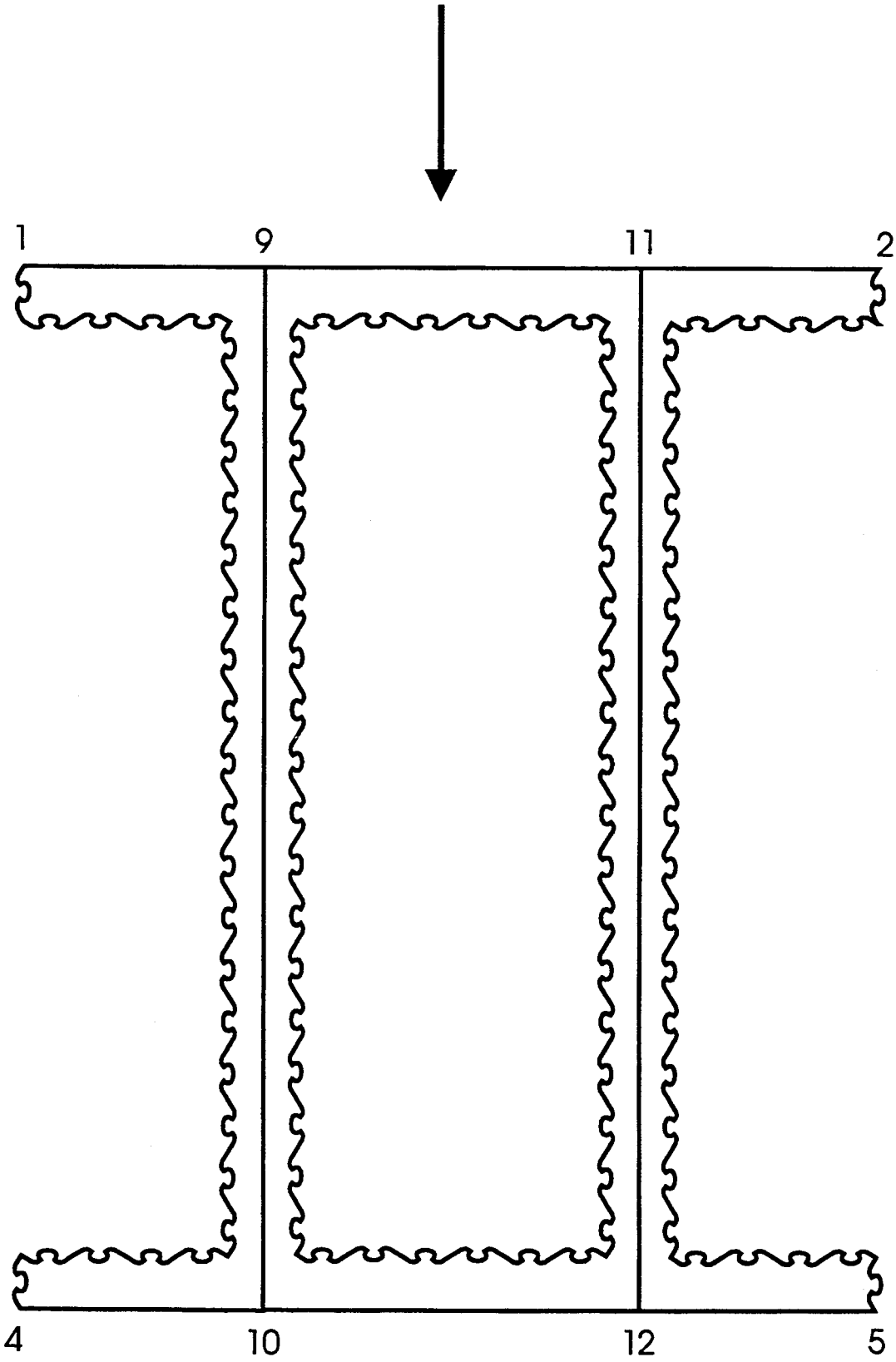
FIG. 2 shows one frame piece connected to two half-frame pieces with a hinged connection indicated.

FIG. 2 shows the first frame piece from FIG. 1 hinge-connected to halves of the second and fourth frame pieces. The interior pieces have been removed. It can be seen that the two half-frame pieces can be pushed away from the cut side of the board and will pivot around hinged connections along lines 9–10 and 11–12.

Figure 3:
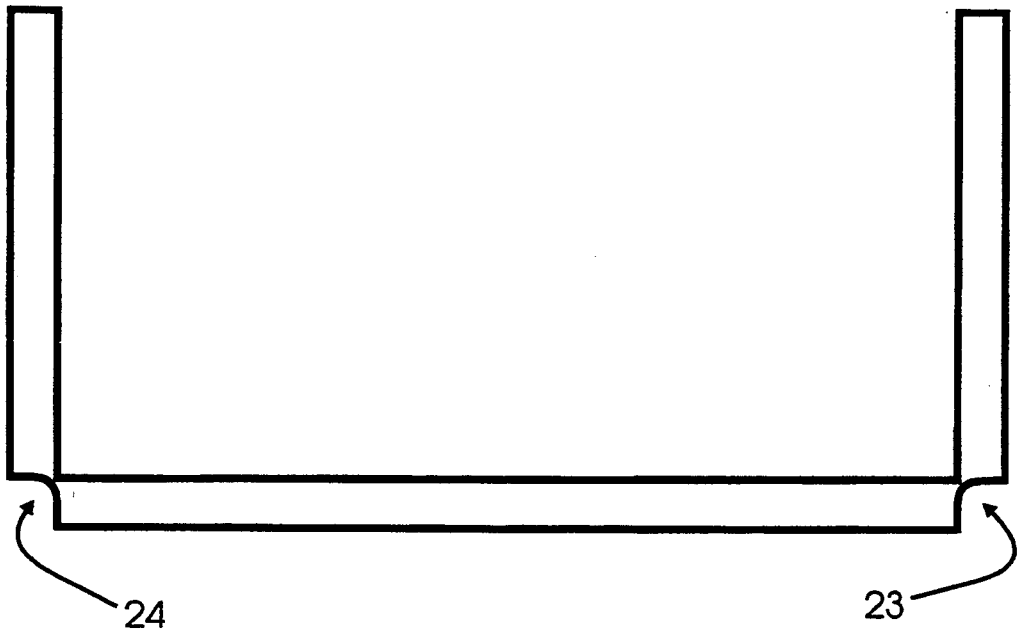
FIG. 3 shows an enlarged edge view of the frame piece in FIG. 2 with a preferred embodiment of the hinged connection.
Figure 4:
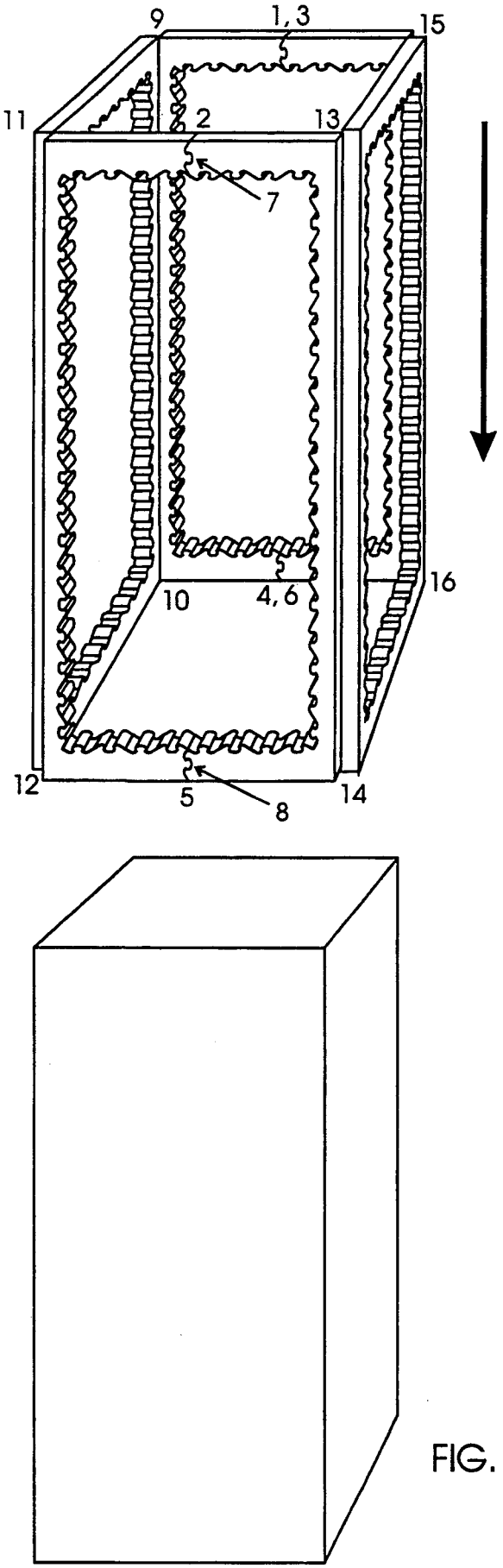
FIG. 4 shows the frame pieces connected to each other and erected into a vertical position to be slipped over a close fitting box.

FIG. 3 is an enlarged edge view of the hinge-connected frame pieces from FIG. 2 looking in the direction of the arrow in FIG. 2 with the two half-frame pieces each pivoted 90 degrees away from the cut side of the puzzle board around the hinged connections formed by partial cuts at 23 and 24. The third frame piece in FIG. 1, hinge-connected to different halves of the second and fourth frame pieces from those shown in FIG. 2 is shown somewhat enlarged in FIG. 6. Its structure is similar to the connected frame pieces in FIG. 2 and it is obvious that its half-frame pieces could also be pivoted 90 degrees as in FIG. 3. When both sets of frame pieces and half-frame pieces are formed as shown in FIG. 3 they may be interlocked to each other as shown in the oblique view in FIG. 4.

in FIG. 4 all four frame pieces are connected together to form the edges and a small portion of four surfaces of a hollow and open rectangular solid. The six faces of this hollow rectangular solid are described by the following six sets of corner points: 9, 15, 13, and 11; 9, 11, 12, and 10; 11, 13, 14, and 12; 13, 15, 16, and 14; 15, 9, 10, and 16; and 10, 12, 14, and 16. The two sets of half-frame pieces are interlocked as at 7 and 8. In the preferred embodiment the four frame pieces thus connected may be placed around or placed over a box as shown by the arrow in FIG. 4. The four frame pieces connected as indicated around a box form four frames into which the interlocking interior pieces may be reassembled using the box for any support which may be needed during reassembly. The four hinge-connected frame pieces thus joined allow the interlocking interior pieces to be assembled vertically with the structure placed on any convenient horizontal surface, even a surface smaller than the fully assembled puzzle if assembled fiat. It will be seen that a major object of the present invention has been achieved.

Figure 5:
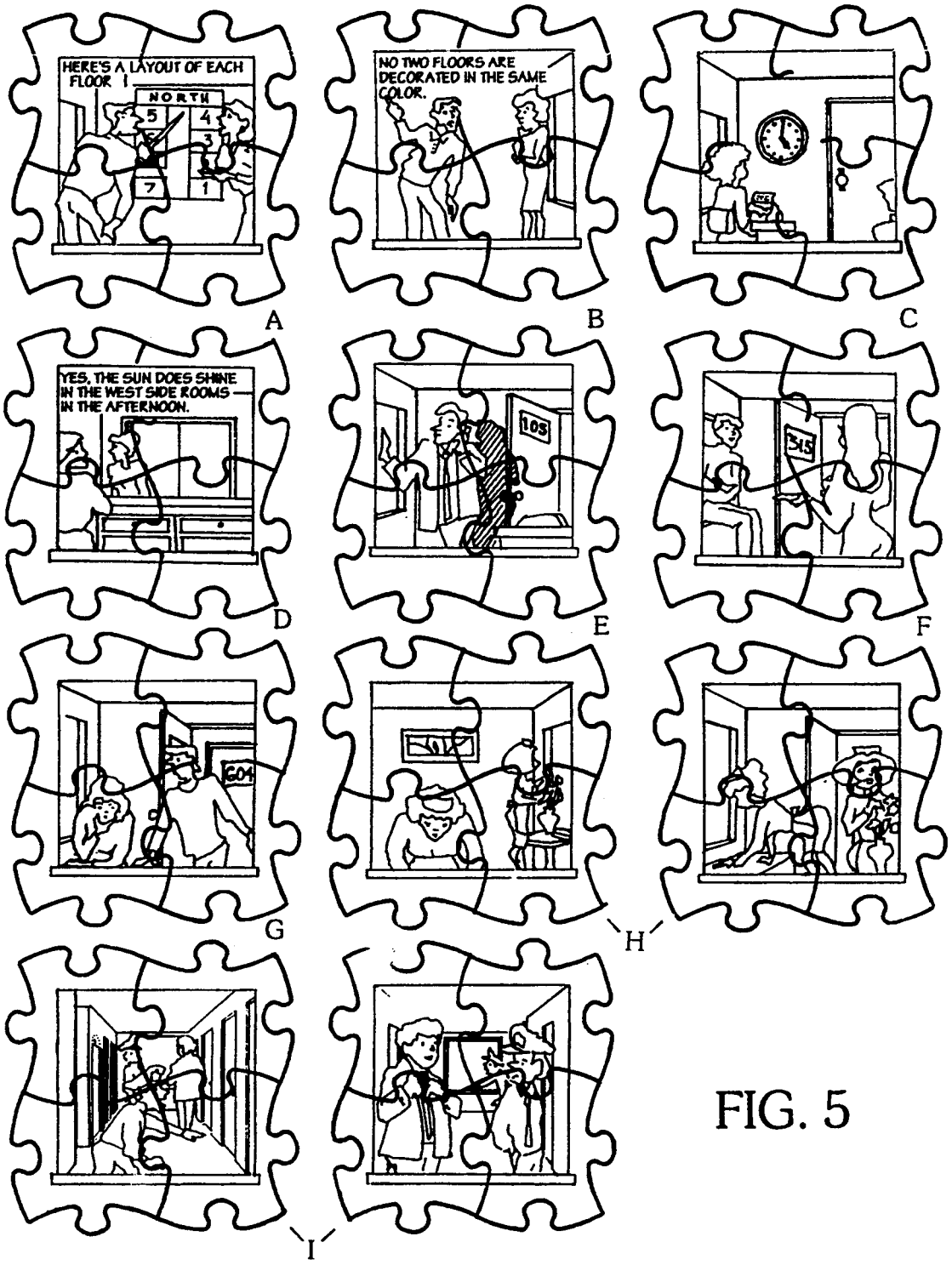
FIG. 5 shows interchangeable clusters of correctly assembled interior pieces with artwork on them.

In the preferred embodiment the interlocking interior pieces must be reassembled into four piece clusters of identical shape using the classical jigsaw puzzle skills of matching colors, patterns, and the shapes of the cut edges. FIG. 5 shows some typical four piece clusters seen to contain artwork. The artwork is laminated to the board such that when the board is further positioned and cut as in FIG. 1, the artwork is centered in the four piece clusters and no lines or patterns or colors cross the cuts between the clusters of interlocking interior pieces. It will be seen in FIG. 5 that the four piece clusters are interchangeable, with no shapes or patterns crossing the edge cuts of the four piece clusters and all edge cuts of the clusters are identical. In all previous jigsaw puzzles, assembly would stop, there being no shapes, patterns or colors to guide further assembly. In the present invention, however, information other than color, pattern, and shape in one cluster determines the placement of that cluster or other clusters and the determining information must be learned or inferred from the set of correctly assembled clusters. In the present invention the mechanical design of the artwork and the mechanical positioning of the artwork relative to the cutting tools cooperate to prevent colors, lines, and patterns from crossing the cuts which define the edges of the assembled clusters. The graphic design of the artwork should be such that it contains information necessary for positioning the clusters relative to each other. The specifics of that graphic design are not a part of the present invention. In the preferred embodiment the artwork is a building with many windows. The windows are arranged so that each window is centered on a four piece cluster which is interchangeable with all other clusters. The graphic designs in FIG. 5 are presented as typical only to describe the kinds of information which could be contained in the correctly assembled clusters. The following examples illustrate the concept.

Figure 6:
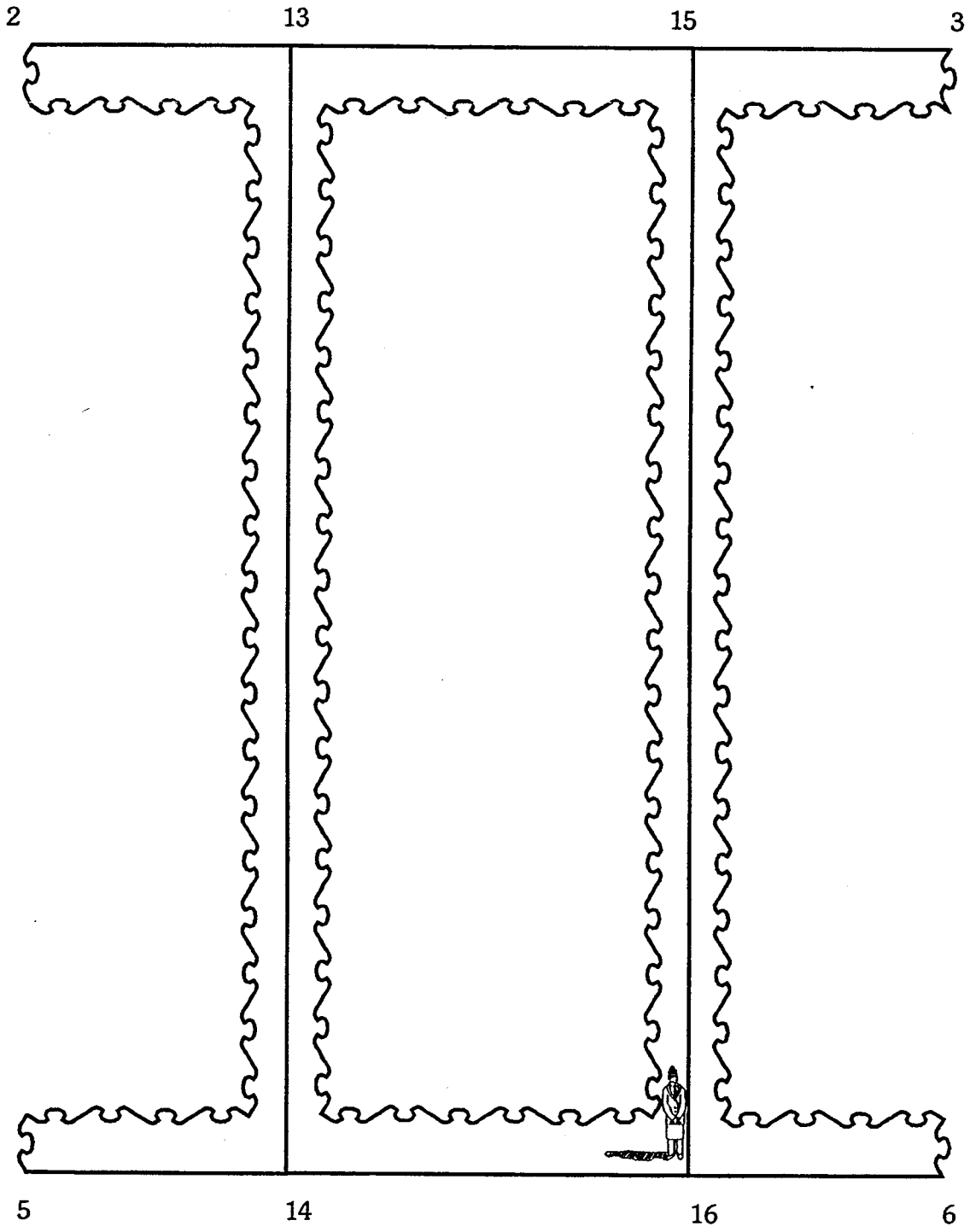
FIG. 6 is a frame piece with artwork on it.

FIG. 5(A) is a cluster in whose window is shown a typical layout of each floor by room number and the location of an intersecting hallway. This information does not help place the cluster containing it but aids in placing other clusters when room numbers are known or when the location of a hallway is known. FIG. 5(B) is a cluster in whose window is revealed a comment about the walls on each floor having their own unique color. FIG. 5(B) is not placed by this comment but in cooperation with other incremental bits of intelligence it helps place nearly all of the other clusters. FIG. 5(C) shows a clock in its window. This establishes the time of day for use in further deducing the placement of interchangeable clusters. FIG. 5(D) shows a window containing a remark about the sun in the afternoon and west side windows. Any cluster with a window showing a shadow can now be placed on the west side of the building. The numbers of rooms on the west side may be determined from 5(A). FIG. 5(E) is a cluster in whose window can be seen a shadow and a room number. This cluster can now be precisely placed on the west side of the building located accurately relative to other rooms on the west side by means of information from 5(A). By referring to FIG. 5(E) the color of the walls of every room on that floor and only that floor can be determined. FIG. 5(F) shows a window of a room with its door open and with the room number on the outside of the door but visible through the window because the door is ajar. The placement of the cluster in 5(F) can be determined precisely. FIG. 5(G) shows a window through which is visible the room number of the room across the corridor. By referring to FIG. 5(A) the placement of the cluster of 5(G) can be determined. FIG. 5(H) shows two clusters in whose windows can be seen two views of the same room, obviously a corner room. If either cluster can be properly placed, the placement of the other follows logically. FIG. 5(I) shows two clusters whose windows are obviously opposite ends of a corridor which has one intersecting hallway on one side. The wall colors will establish the floor and reference to FIG. 5(A) determines that the first of the two windows is the south end because the intersecting hallway is on the left and is known to be on the west side. FIG. 5 shows typical information which could be placed in the clusters of correctly assembled pieces and is not intended to limit or to define the present invention. In FIG. 6 the single figure of a man casting a shadow along with the time known from the clock in FIG. 5(C) clearly establishes that the frame piece defined by corner points 13, 15, 16, and 14, is the north face of the building and all other faces are immediately known.

FIG. 6 shows that any artwork for frame pieces must be mechanically designed and mechanically positioned so as not to cross the cut lines which define the edges of the frame pieces.

It will be obvious to anyone familiar with jigsaw puzzles that the design of the jigsaw puzzle described in the foregoing paragraphs and the method of positioning and cutting said jigsaw puzzle are different from all existing and previous art. It is also clear that the method of reassembly of said jigsaw puzzle is substantially new and different and requires a completely different set of skills in addition to the classical skills required to solve a jigsaw puzzle and that another major object of the present invention has been achieved.

Having set forth the disclosure of my invention, I claim:

1. A jigsaw puzzle comprising interlocking interior pieces and at least three rectangular frame pieces which completely surround and interlock with the interior pieces and are joined by a hinge along parallel sides so that the resulting structure may stand vertically on one of its non hinged edges allowing the interlocking interior pieces to be assembled into the resulting hinged vertical frame pieces, at least one of said frame pieces is cut into two interlocking half-frames by cutting its non hinged opposite sides with an interlocking shaped cut holding the two half-frames together when assembled.

2. A jigsaw puzzle as in claim one wherein there are four rectangular frame pieces, two of which are cut into half-frames, and the resulting structure with half-frames assembled is designed to stand around a box providing four surfaces against which to assemble the interlocking interior pieces, which support the hinge-joined frame structure, and into which box all frame pieces and interlocking interior pieces may be packaged.

3. A jigsaw puzzle as in claim two in which the interior interlocking pieces must be assembled into clusters representing windows using the skills of matching color, patterns, and shape and in which the four frame pieces represent the four walls of a building into which the clusters representing windows must be placed using information other than shape, color, and patterns, such information only to be learned by studying the correctly assembled clusters representing windows.

4. A jigsaw puzzle as in claim one where the frame pieces and half-frame pieces are first joined along equal parallel edges in a solid coplanar joint and are subsequently made into hinge-joined frame pieces by partially cutting the material of the frame pieces so that the frame pieces bend relative to each other along the partial cuts and form hinged joints.

5. A jigsaw puzzle comprising interlocking pieces wherein some of the pieces are first assembled into physically interchangeable clusters of pieces containing two or more pieces using the classical jigsaw puzzle skills of matching shapes, colors and patterns, wherein the determination of how and where the clusters should be placed relative to each other and to other non cluster portions of said jigsaw puzzle must be made using information revealed only in the correctly assembled clusters, which information is other than piece shape, color, and pattern.

6. A jigsaw puzzle as in claim three wherein the clusters are composed of four pieces in a substantially rectangular format representing windows in the wall or walls of a building and wherein the non cluster pieces represent the rest of the building.

* * * * *